US007748560B2

(12) United States Patent
DaCosta et al.

(10) Patent No.: US 7,748,560 B2
(45) **Date of Patent: *Jul. 6, 2010**

(54) ATMOSPHERE CONTROLLED PACKAGING FOR FRESH FOODSTUFFS

(75) Inventors: Nicholas DaCosta, Danville, CA (US); Elizabeth Varriano-Marston, Windham, NH (US); Eugene P. Thomas, Santa Cruz, CA (US)

(73) Assignee: Taylor Fresh Vegetables, Inc., Salinas, CA (US)

( * ) Notice: Subject to any disclaimer, the term of this patent is extended or adjusted under 35 U.S.C. 154(b) by 177 days.

This patent is subject to a terminal disclaimer.

(21) Appl. No.: 11/484,062

(22) Filed: Jul. 11, 2006

(65) Prior Publication Data

US 2008/0014383 A1 Jan. 17, 2008

(51) Int. Cl.
*B65D 1/24* (2006.01)
*B65D 51/16* (2006.01)

(52) U.S. Cl. ..... 220/526; 220/367.1; 220/371; 220/523

(58) Field of Classification Search ..... 220/783, 220/796–798, 254.1, 366.1, 360, 361, 526, 220/4.21, 371, 521, 523; 206/561, 557, 541, 206/550

See application file for complete search history.

(56) References Cited

U.S. PATENT DOCUMENTS

| | | | |
|---|---|---|---|
| 2,170,062 | A | 8/1939 | Nordmark |
| 2,731,996 | A | 1/1956 | Hayes |
| 3,031,309 | A | 4/1962 | Bogner et al. |
| 3,038,625 | A | 6/1962 | Sinner et al. |
| 3,079,028 | A | 2/1963 | Rosner |
| 3,104,776 | A | 9/1963 | Bostrom |
| 3,107,027 | A | 10/1963 | Hong |
| 3,244,537 | A | 4/1966 | Cease |

(Continued)

FOREIGN PATENT DOCUMENTS

DE 19948894 C1 * 7/2000

(Continued)

OTHER PUBLICATIONS

"Apio Expands Use of Smart Packaging", http://www.packworld.com/cdsprint.html?recid=10348, © 1994-2004 Summit Publishing, Inc., 4 pages.

(Continued)

*Primary Examiner*—Robin Hylton
(74) *Attorney, Agent, or Firm*—Weide & Miller, Ltd.

(57) ABSTRACT

An atmosphere controlled, resealable foodstuff container includes a base tray and a cover. The cover and base tray are constructed of a substantially gas impermeable material. The cover and base tray include resealing members. When connected, the cover and base tray define a generally enclosed and sealed interior space for foodstuffs. The container includes at least one atmosphere control member, such as a membrane, which controls the flow of gases through an opening in the container. The member may be located over a recessed opening in the cover to permit the containers to be stacked without gas flow interference. A label extends over the recess, thus obscuring the membrane from view to the purchaser without affecting the membrane atmosphere control function. The base tray may be opaque for use as a serving tray and the cover transparent to permit viewing of the product.

7 Claims, 3 Drawing Sheets

U.S. PATENT DOCUMENTS 3,247,988 A 4/1966 Cease
3,301,460 A 1/1967 Harrison
3,305,126 A 2/1967 Cease
3,487,972 A 1/1970 Swett
3,507,667 A 4/1970 Magnen
3,595,425 A * 7/1971 Eicholtz et al. ..... 220/556
3,610,458 A 10/1971 Nissley
3,633,322 A 1/1972 Morcom
3,749,299 A 7/1973 Ingle
3,915,532 A 10/1975 Ashton
4,013,798 A 3/1977 Goltsos
4,055,672 A 10/1977 Hirsch et al.
4,081,646 A 3/1978 Goltsos
4,124,141 A * 11/1978 Armentrout et al. ..... 220/783
D250,928 S 1/1979 Franklin
4,159,062 A 6/1979 Levenhagen
4,272,008 A 6/1981 Wozniacki
4,328,254 A 5/1982 Waldburger
4,335,842 A 6/1982 Bradford et al.
4,346,833 A 8/1982 Bernhardt
D269,930 S 8/1983 Powers
4,574,174 A * 3/1986 McGonigle ..... 219/735
4,593,816 A 6/1986 Langenbeck
4,660,716 A 4/1987 McMahon et al.
4,664,922 A 5/1987 Leon et al.
4,685,274 A 8/1987 Garwood
4,769,262 A 9/1988 Ferrar et al.
4,821,884 A 4/1989 Griffin et al.
4,830,863 A 5/1989 Jones
4,842,875 A 6/1989 Anderson
4,874,083 A 10/1989 Antoni et al.
4,879,078 A 11/1989 Antoon
D305,205 S 12/1989 Grindrod et al.
4,886,372 A 12/1989 Greengrass et al.
D305,409 S 1/1990 Michaud et al.
4,910,032 A 3/1990 Antoon
4,923,703 A 5/1990 Antoon
4,939,332 A 7/1990 Hahn
4,943,440 A 7/1990 Armstrong
4,966,295 A 10/1990 Parrish
D318,207 S 7/1991 Anderson
5,045,331 A 9/1991 Antoon, Jr.
5,119,940 A 6/1992 Grindrod
5,123,527 A 6/1992 Hustad
5,160,768 A 11/1992 Antoon
5,165,947 A 11/1992 Colucci et al.
5,254,354 A 10/1993 Stewart
5,277,329 A 1/1994 Pomroy et al.
5,308,630 A 5/1994 Nordahl
5,375,701 A 12/1994 Hustad et al.
D361,508 S 8/1995 Schnack
5,492,703 A 2/1996 Gics
5,503,858 A 4/1996 Reskow
D382,796 S 8/1997 Mangla
5,657,874 A 8/1997 Hustad et al.
5,672,406 A 9/1997 Challis et al.
D384,861 S 10/1997 Richard
5,705,213 A 1/1998 Guillin
5,718,101 A 2/1998 Noel et al.
5,730,313 A * 3/1998 Hayes et al. ..... 220/526
5,743,402 A 4/1998 Gics
5,759,650 A 6/1998 Raines et al.
5,779,050 A 7/1998 Kocher et al.
5,832,699 A 11/1998 Zobel
5,843,501 A 12/1998 Rubin et al.
5,866,181 A 2/1999 Hill
5,901,848 A 5/1999 Gorlich et al.
5,908,649 A 6/1999 Floyd et al.
5,916,615 A 6/1999 Brady et al.
5,943,844 A 8/1999 Wilhelm et al.
5,948,457 A 9/1999 DelDuca et al.
D415,422 S 10/1999 McCann
5,988,426 A * 11/1999 Stern ..... 220/371
6,013,293 A 1/2000 DeMoor
6,054,153 A 4/2000 Carr et al.
6,083,550 A 7/2000 Cochran et al.
6,085,930 A 7/2000 Curtis
6,092,664 A 7/2000 Bartosek
RE36,867 E 9/2000 Rozzano
6,129,235 A 10/2000 Creske
6,152,302 A 11/2000 Miller et al.
6,210,724 B1 4/2001 Clarke et al.
6,210,725 B1 4/2001 Colombo
6,213,302 B1 4/2001 Sanders et al.
6,221,411 B1 4/2001 Sanfilippo et al.
6,231,905 B1 5/2001 DelDuca et al.
6,296,923 B1 10/2001 Zobel
6,302,324 B1 10/2001 Buchko
6,376,032 B1 4/2002 Clarke et al.
6,408,598 B1 6/2002 Stockley, III
6,441,340 B1 8/2002 Varriano-Marston
6,447,825 B1 9/2002 Korsten
6,461,702 B2 10/2002 Gong
6,527,121 B1 3/2003 Flynn
6,595,366 B1 7/2003 Brown
6,596,328 B1 7/2003 Bezek et al.
D482,280 S 11/2003 Pratte
6,651,874 B1 11/2003 Pedersen
6,667,067 B1 12/2003 Noel et al.
6,740,346 B2 5/2004 Shapiro
6,880,748 B2 4/2005 Machado et al.
6,919,097 B2 7/2005 Lamp et al.
7,083,818 B2 8/2006 Pratte
7,083,837 B1 8/2006 Varriano-Marston
7,141,256 B2 11/2006 Noel et al.
2003/0031769 A1 2/2003 Wyslotsky
2003/0035868 A1 2/2003 Coulter et al.
2003/0057217 A1 3/2003 Wyslotsky et al.
2003/0087015 A1 5/2003 Wyslotsky
2003/0106829 A1 6/2003 Costello
2003/0134013 A1 7/2003 Noel et al.
2003/0152670 A1 8/2003 Shih
2003/0152676 A1 8/2003 Garwood
2003/0183631 A1 * 10/2003 Cross et al. ..... 220/203.17
2005/0244546 A1 11/2005 Steffen
2006/0121161 A1 6/2006 Garrett
2007/0138046 A1 * 6/2007 Vovan ..... 206/509

FOREIGN PATENT DOCUMENTS

EP 0223567 5/1987
EP 0270764 6/1988
EP 035116 1/1990
EP 0351116 A2 1/1990
EP 0391712 10/1990
EP 0414451 2/1991
EP 437081 A1 7/1991
EP 0437082 7/1991
EP 0450213 9/1991
EP 0482281 4/1992
EP 482281 4/1992
EP 0749897 12/1996
EP 1298072 4/2003
EP 1382544 1/2004
EP 1526077 4/2005
FR 2606752 5/1988
FR 2663904 1/1992
FR 2726534 9/1994
FR 2719289 11/1995
FR ES2211254 7/2004
FR 2856657 12/2004
GB 2088700 6/1982
GB 2307634 6/1997
GB 2339766 2/2000

| | | |
|---|---|---|
| GB | 2340471 | 2/2000 |
| JP | 62236441 | 10/1987 |
| JP | 1-150784 | 6/1989 |
| JP | 7315384 | 5/1994 |
| JP | 7-87884 | 4/1995 |
| JP | 7-315384 | 7/1995 |
| JP | 9058653 | 8/1995 |
| JP | 8085508 | 4/1996 |
| JP | 8-337209 | 12/1996 |
| JP | 8337209 | 12/1996 |
| JP | 9-315435 | 12/1997 |
| JP | 2000-85752 | 3/2000 |
| JP | 2003-237773 | 8/2003 |
| JP | 2004284595 | 10/2004 |
| JP | 2005-8172 | 1/2005 |
| JP | 2005193951 | 7/2005 |
| WO | WO 90/08474 | 8/1990 |
| WO | WO 94/12040 | 6/1994 |
| WO | WO 97/27050 | 7/1997 |
| WO | WO 00/04787 | 2/2000 |
| WO | WO 00/78635 | 12/2000 |
| WO | WO 01/89310 | 11/2001 |
| WO | WO/2004/016118 | 2/2004 |
| WO | WO 2006/008398 | 1/2006 |

OTHER PUBLICATIONS

"Smart Package—Controlled Gas Permeation",http://packworld.com/cds_search.html'' rec_id=12235&prr_key=intellipac&ter..., © 1994-2004 Summit Publishing, Inc., 4 pages.

Declaration of Nicholas DaCosta, dated Aug. 25, 2006, in 19 pages.

1989 DuPont Awards, "Freshhold® Packaging Systems" in 2 pages.

"Outsourcing Pre-cut Veggies Avoids Preparation Costs", Prepared Foods, Jun. 1996, © 1996 Cahners Publishing Company, 1 page.

* cited by examiner

ATMOSPHERE CONTROLLED PACKAGING FOR FRESH FOODSTUFFS

FIELD OF THE INVENTION

The present invention relates to packaging for fresh foodstuffs such as fruits and vegetables.

BACKGROUND OF THE INVENTION

A problem in the delivery of fresh produce to retail markets is maintaining acceptable quality throughout the distribution system. In addition, shelf life must be maximized to benefit both the fresh produce processor and the consumer. It is also desirable to have a functional and aesthetic package that catches the consumer's eye and can be easily displayed on retail shelves without extra effort by in-store produce personnel.

Many package designs for fresh produce are based on maintaining a controlled or modified atmosphere inside the package during transport, storage, and display. Modified atmospheres help to maintain product quality and shelf life throughout product distribution, display, and use by consumers. For one segment of the produce market, a variety of fresh cut produce items are packed into a multi-compartment "Party Tray" consisting of a thermo-formed tray filled with fresh-cut produce with a lidding film hermetically heat-sealed to the flange of the tray. Because fresh produce continues to respire during storage, lidding film is made breathable either through perforations in the lidding film or the application of a breathable membrane over a hole in the lidding film. The required breathability of the entire package is determined by the type of produce inside the package, the respiration rate of that produce, and the expected storage temperature the package will endure.

One Party Tray currently in use consists of a clear polyester (PETE) dome which is heat-sealed with a PET lidding film, followed by snapping on an opaque cover. This Party Tray is displayed upside down so that the fresh produce can be viewed through the clear polyester dome. The opaque cover doubles as a serving tray for the consumer. There are several problems with this Party Tray design. First, the tray has the breathable member (micro-perforations or breathable membrane) on the lidding film which can be occluded by product or by the serving tray. Even though the lid or serving tray is designed with grooves to reduce the possibility of occluding the breathable member included on the lidding film, this is not a fool-proof method to assure that occlusion is avoided. Another deficit in the current "Party Tray" design is the fact that once the lidding film is removed from the thermo-formed dome, the tray cannot be hermetically resealed, thereby reducing the shelf life of the fresh produce contained within the tray.

An improved package for produce and similar fresh foodstuffs is desired.

SUMMARY OF THE INVENTION

The invention comprises an atmosphere controlled package which is particularly useful for storing fresh foodstuffs such as fruits and vegetables. The invention also comprises methods of forming and using the packaging.

In one embodiment, an atmosphere controlled, resealable foodstuff container includes a base tray and a cover. The cover and base tray are constructed of an essentially or substantially gas impermeable material.

The cover and base tray may be selectively connected and disconnected. When connected, the cover and base tray define a generally enclosed and sealed interior space. When disconnected, access to the interior space and foodstuffs or other stored goods, is provided.

In a preferred embodiment, the cover and base tray include mating locking/sealing members. A downwardly extending trough or tongue extends around the periphery of the cover for press-fitting into a recessed portion of the base against an upwardly extending wall thereof.

In one embodiment, the base tray is generally concave and the cover is convex, so that when connected they form a storage space. In one embodiment, the cover defines one or more compartments comprising raised areas which are separated at least partially from one another. The cover may be generally transparent to permit foodstuffs to be viewed therethrough, while the tray may be generally opaque for use as a serving platter.

The container includes at least one atmosphere control member for controlling the flow of gases through an opening in the container. In one embodiment, the atmosphere control member comprises a gas permeable membrane which is located over an opening in the container. In a preferred embodiment, the opening is located in a recessed portion on top of the cover, thus permitting the containers to be stacked upon one another without contacting the membrane and interfering with the operation thereof.

In one embodiment, a label extends over the atmosphere control member to obscure it from view. The label may extend over the entire recessed or inset area in which the atmosphere control member is located. Passages may be provided to permit gas to flow into and out of the area of the member.

The invention comprises a simple, and yet effective, container for fresh foodstuffs and other goods. Advantageously, the container can be resealed after it is first opened by a consumer. This aids in maintaining freshness of the stored foodstuffs over time.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises packaging which is particularly suited for storing and transporting fresh foodstuffs, such as fruits and vegetables. The packaging comprises a re-sealable, atmosphere-controlled container. Preferably, the container is comprised of at least two mating portions which are essentially gas impermeable, with at least one of the mating portions having an associated atmosphere control member.

Figure 1:
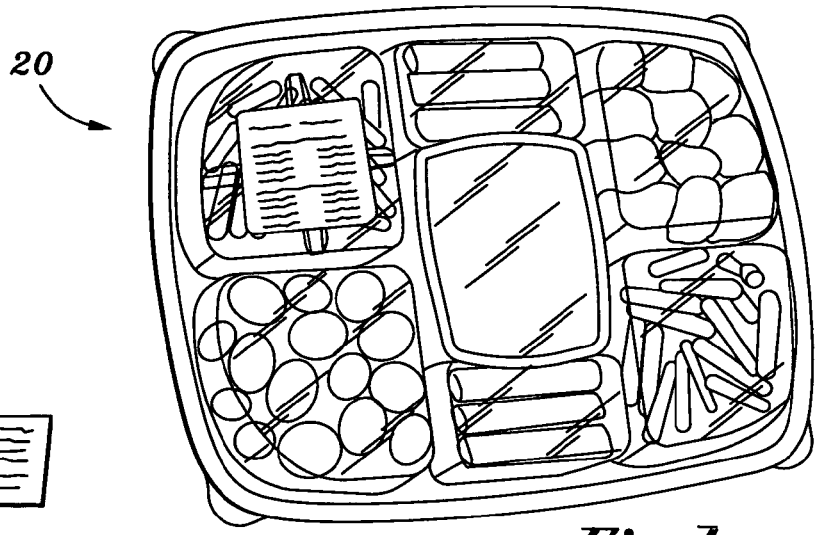
FIG. 1 is a perspective view of a container in accordance with the invention.
Figure 2:
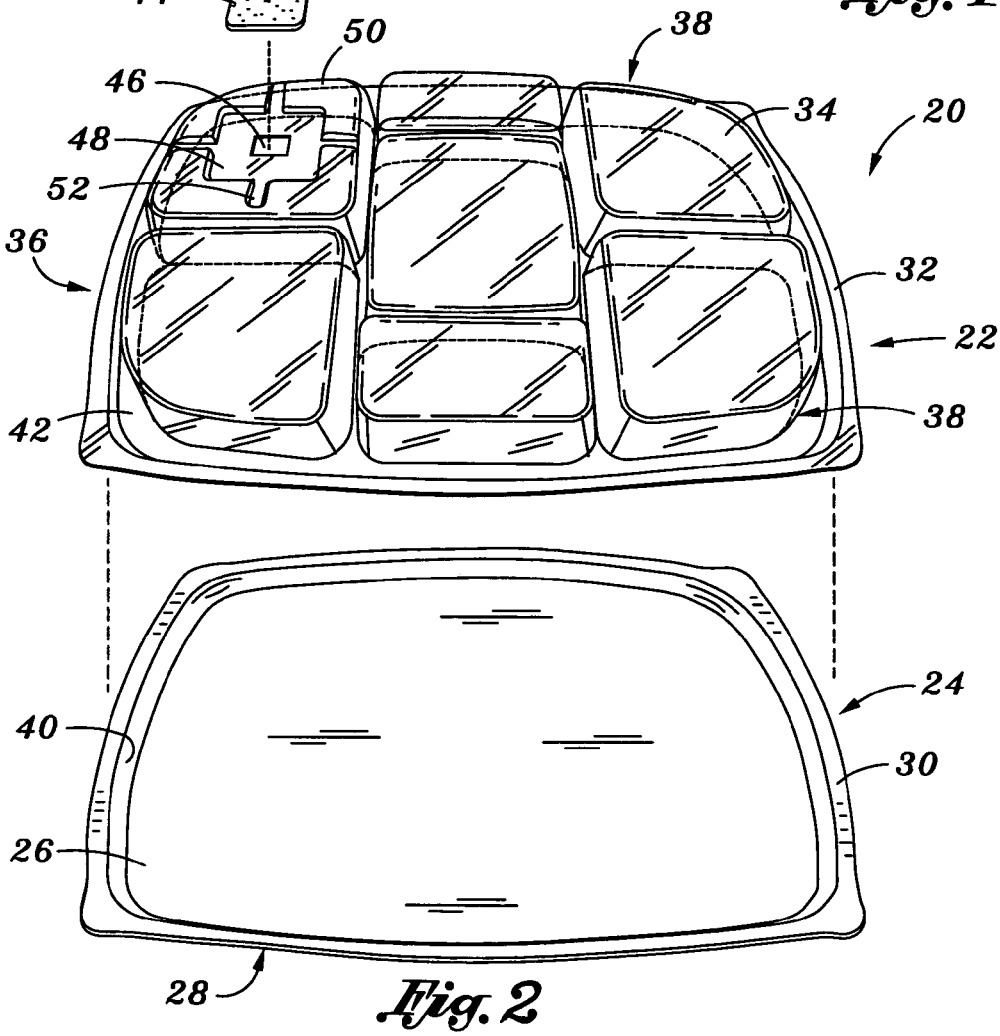
FIG. 2 is an exploded view of the container illustrated in FIG. 1.

One embodiment of the invention will be described with reference to FIG. 1. FIG. 1 illustrates a foodstuff package or container 20. As best illustrated in FIG. 2, in one embodiment, the container 20 comprise two selectively mateable portions 22,24. As illustrated, a first portion 22 comprises a "top" or "cover" of the container 20, while the second portion 24 comprises a "bottom" or "tray" of the container 20. It will be appreciated that the terms "top" and "bottom" are relative, in that the container 20 may be placed in various orientations. These particular terms are utilized with reference to the particular orientation of the container 20 as illustrated.

In one embodiment, the container 20 is generally rectangular in peripheral shape. The container 20 may have a variety of shapes, however, such as oval, square, round, triangular or even irregular. Generally, the shape of the container 20 is dictated by the shapes of the top and bottom portions 22,24 thereof.

As indicated, the bottom portion 24 of the container 20 is preferably configured as a tray. The top portion 22 is configured as a cover having one or more compartments. In this configuration, foodstuffs are generally located in the compartments of the top portion 22 and retained or enclosed by the bottom portion 24. In use, the container 20 is generally oriented so that the bottom portion or tray 24 rests upon a support surface, while the top portion or cover 22 is located over and encloses the foodstuffs.

Figure 5:
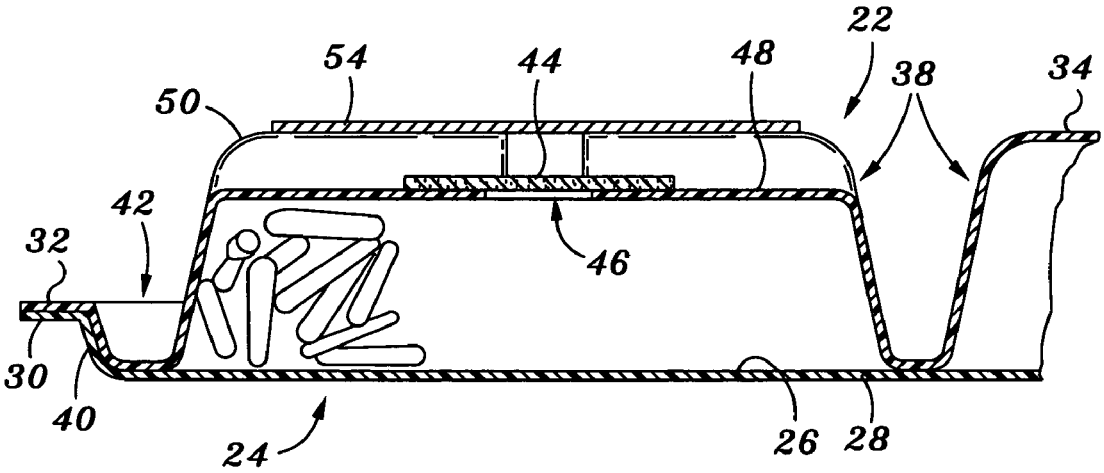
FIG. 5 is a cross-sectional view of the portion of the container illustrated in FIG. 4 taken along line 5-5 therein.

Referring to FIGS. 2 and 5, the bottom portion or tray 24 has an inside or top surface 26, an outside or bottom surface 28, and a peripheral edge 30. In one embodiment, the bottom portion 24 comprises a base having an outwardly extending (or upwardly extending, when the container is in its normal orientation) wall. As illustrated, the peripheral edge 30 comprises a flange which extends outwardly from the wall generally opposite the base. In this configuration, the bottom portion 24 is generally concave, in that the inside surface 26 has the form of a depression. The depth of the tray may vary depending upon the desired use. In one embodiment, the tray has a relatively shallow depth (for example, having a depth which is less than its peripheral dimension, such as dimension from side to side or end to end).

The top portion 22 may have a variety of configurations. Generally, the top portion 22 is configured as a container for containing foodstuffs. The top portion 22 has a periphery or outer edge 32, an outside or top surface 34, and an inside or bottom surface 36. In one embodiment, the top portion 22 has a top with an outwardly extending (or downwardly extending, when the container is in its normal orientation) wall. As illustrated, the peripheral edge 32 extends outwardly beyond a "U" shaped trough 42. This trough 42 is configured to tightly engage upstanding wall of the bottom portion 24, thereby permitting the top and bottom portions 22,24 to engage one another in a press-fit locking arrangement, as described in more detail below.

Still referring to FIGS. 2 and 5, in this configuration, the top portion or cover 22 is generally convex, such that one or more portions of the outside surface 34 are raised or extend away from the edge 32. In a preferred embodiment, the top portion 22 defines a plurality of compartments 38. These compartments 38 are at least partially divided or separated from one another. As illustrated, certain portions of the top are raised or extend outwardly farther than others relative to the peripheral edge or flange 32. The portions which extend outwardly define the compartments 38, while the portions there between generally serve as dividers between the compartments. It will be appreciated that the number of compartments and their shapes and sizes may vary. As illustrated, there are three central compartments with two side compartments on either side thereof. There may be as few as one compartment (where the entire top of the top portion raised), but there are preferably at least two compartments and there may be, as illustrated, numerous compartments.

In a preferred embodiment, the top and bottom portions 22,24 are preferably constructed of a generally gas or air-impermeable material. Preferably, by "air-impermeable" it is meant that atmospheric gas at normal room pressures does not readily pass through the top and bottom portions 22,24. For example, the top and bottom portions 22,24 may be vacuum formed from a plastic material. So that the food stuffs may be viewed by a consumer, the top portion 22 may be constructed of a generally clear or transparent material. In a preferred embodiment, the bottom portion 24 is constructed of a generally opaque material, such as a black plastic. In this manner, the bottom portion 24 may be used as a serving tray.

Means are provided for selectively connecting the top and bottom portions 22,24 to form a closed container. More preferably, the means allow the top and bottom portions 22,24 to be connected in a manner which causes the container 20 to define a generally sealed interior space (i.e. generally atmospherically sealed or controlled). Most preferably, the means for connecting allows the top and bottom portions 22,24 to be selectively connected and disconnected, meaning that the container 20 can be opened and closed, as desired.

In one embodiment, the top and bottom portions 22,24 are connectable by mating first and second locking or sealing members. As described above and illustrated in FIGS. 2 and 5, the bottom portion 24 includes an upwardly extending wall 40. The wall 40 may have various shapes and sizes. In one embodiment, the wall 40 is located adjacent to the periphery 30 and slopes upwardly and outwardly to work with the trough 42 of the top portion 22 in a "wedging" arrangement to lock the top and bottom portions 22,24.

As indicated above, the top portion 22 includes a mating trough or tongue 42. The trough or tongue 42 is preferably defined at the bottom of the top portion 22, near the periphery 32 thereof. The trough 42 and wall 40 are configured to mate, and as such, the trough 42 is located in a position on the top portion 22 which corresponds to the location of the wall 40 of the bottom portion 24.

In a preferred embodiment, the trough 42 is sized and shaped to fit tightly against the wall 40. When the wall 40 is continuous, the trough 42 is preferably continuous. As illustrated, an outside surface of the trough 42 is configured as a wall portion with the same slope and shape as the wall 40. Preferably, that portion of the trough 42 is movable relative to the remaining portion of the top portion 22 (will flex inwardly towards the portion of the top separated therefrom by the trough), so that the wall portion will spring fit or compress into engagement with the wall 40. In this manner, the top portion 22 may be press-fitted tightly into engagement with the bottom portion 24.

The container 20 also includes means for controlling the atmosphere therein. When the top and bottom portions 22,24 are connected, they define a generally closed, sealed interior space. In other words, the atmosphere within the container 20 does not interact with the atmosphere outside of the container, owing to the generally atmosphere impermeable nature of the top and bottom portions 22,24 and their sealing connection.

Preferably, however, the container 20 includes a means for controlling exchange of gases between the interior and exterior of the container 20.

As illustrated in FIGS. 2-5, in one embodiment, the container 20 includes an atmosphere control member 44. In one embodiment, the member 44 comprises a membrane which selectively allows gas to flow therethrough.

Figure 3:
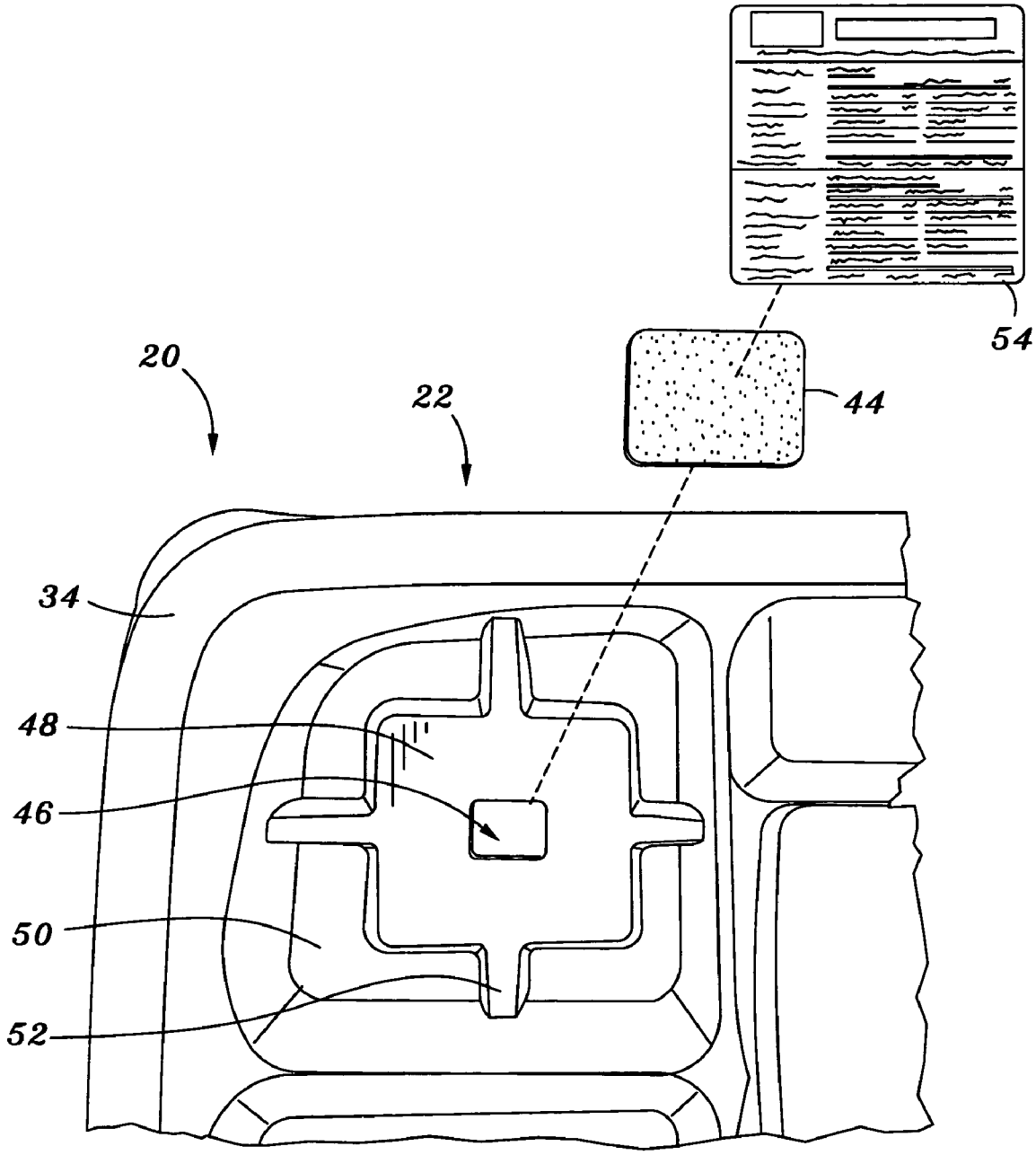
FIG. 3 is an enlarged exploded view of a portion of the container illustrated in FIG. 1.
Figure 4:
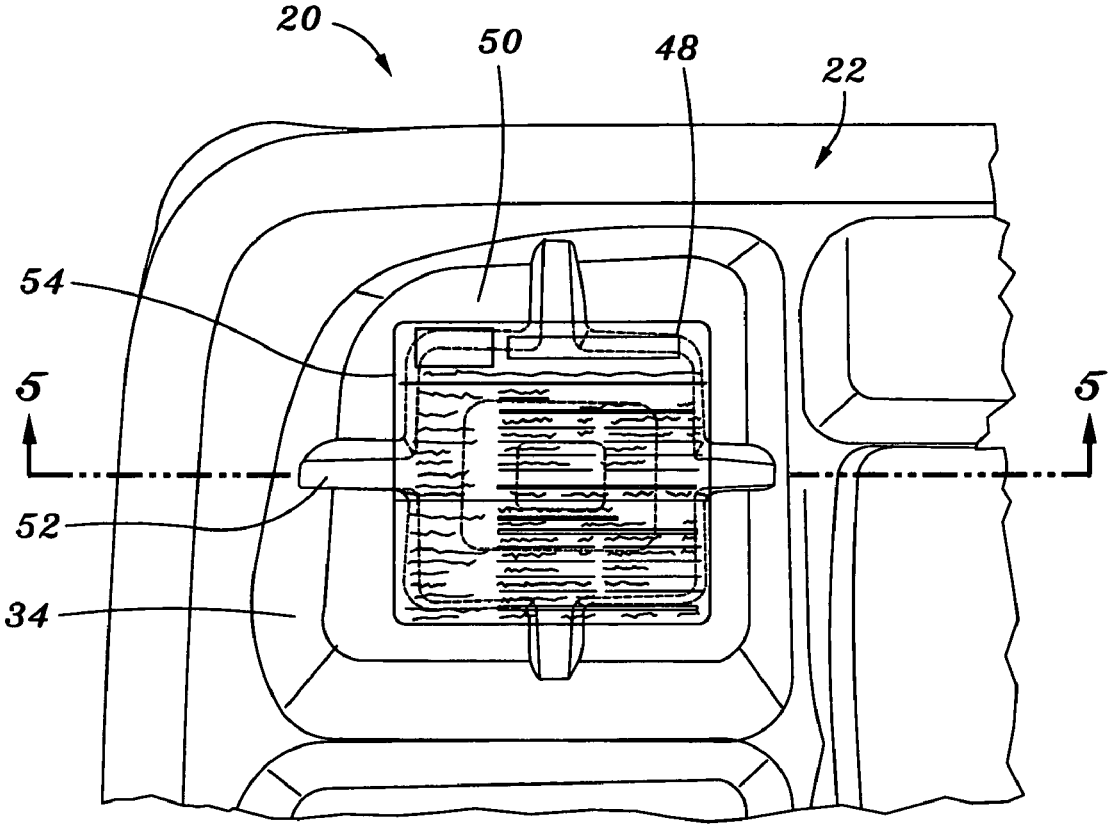
FIG. 4 is an enlarged assembled view of the portion of the container illustrated in FIG. 4.

Referring to FIGS. 2,3 and 5, the container 20 defines an opening 46. In one embodiment, the opening 46 is located in the top portion 22. The atmosphere control member 44 is associated with the opening 46, preferably by being located over the opening, to selectively control the passage of gases through the opening 46.

In one embodiment, the atmosphere control member 44 is a microporous film made from polyolefin polymers such as polypropylene or polyethylene. The member 44 is generally planar and is dimensionally larger than the opening 46, whereby at least a portion of the member 44 extends beyond the opening around the periphery thereof. The member 44 may be sealed to the top portion 22, such as with a pressure sensitive adhesive that is applied to the periphery of the atmosphere control member 44.

The size and shape of the member 44 (and thus associated opening 46) may vary. The size of the member 44 and associated opening 46 may vary, at least in part, by the size of the container 20 (or the interior space), the types of foodstuffs to be stored, or other factors. The number of members 44 may also, or instead, be varied depending upon such factors.

For convenience, the member 44 may be located at the outside or top 34 of the top portion 22. Preferably, the member 44 is inset from the very top of the top portion 22, whereby if the containers 20 are stacked or if other items are placed on the container 20, the member 44 is not blocked. In one embodiment, as illustrated, the member 44 is located at an inset portion 48 of the top of the top portion 22. The inset portion 48 may comprise a slightly recessed area of one of the compartments 38. One or more raised areas 50 at least partially surround the inset portion 48.

The depth of the inset portion 48 relative to the raised areas 50 may vary. The depth need not be particularly great, but only sufficient to prevent a container or other object from resting directly on the member 44 and preventing or obstructing the flow of gases therethrough. Preferably, the inset portion 48 is relatively small, so that the raised areas 50 will support a portion of another container 50 or other object without that portion or object fitting within the inset portion 48 (i.e. the raised areas 50 generally prevent a portion of a container or other object from resting upon the member 44).

To allow gases to flow to and from the inset area 48, one or more slots 52 or other passageways may be defined through or between the raised areas 50. In this manner, if a container 20 or other object is resting upon the raised areas 50, that container or object not only does not contact the member 44, but does not occlude the inset area 48 from the atmosphere around the container 20.

In a preferred embodiment, a packaging label 54, such as containing consumer information, is located over the inset area 48, and thus the member 44, thus obscuring the member 44 from view, but not preventing its operation. In the embodiment illustrated in FIG. 5, the label 54 may be sized so that it is associated with the raised areas 50, but covers or extends over the inset area 48. In this manner, the member 44 is hidden from view, but gases are allowed to flow to and from the member 44 via the passageways 52.

It will be appreciated that the container 20 may have a variety of other configurations which provide for one or more atmosphere control members 44, but which ensure the proper operation thereof.

Use of the container 20 will now be described. As indicated, in a preferred embodiment, the top portion 22 defines one or more compartments 38. As such, the top portion 22 is inverted (so that the inside surface 36 is facing upwardly) and loaded with foodstuffs. Different foodstuffs may be loaded into the various compartments, as desired.

Once filled, the bottom portion 24 is inverted and placed over the top portion 22 and the foodstuffs (i.e. the bottom portion 24 is oriented so that its inside surface 26 faces the top portion 22 and the foodstuffs). The top and bottom portions 22,24 are preferably connected to one another. In one embodiment, this comprises engaging the connecting or sealing means, such as by pressing the trough 42 of the top portion 22 into engagement with the wall 40 of the base portion 24.

The container 20 may then be inverted so that it rests upon the bottom portion 24 and so that the foodstuffs are viewable through the top portion 22. If not already applied, a packaging label 54 may be affixed to the container 20 over the atmosphere control member(s) 44.

If desired, a seal may be associated with the container 20 to provide an indication to the consumer that the container 20 has not been opened prior to purchase. For example, a sealing member, such as a shrink or stretch band, may be located around the edge of the container 20 where the peripheral portions 30,32 of the top and bottom portions 22,24 are located adjacent one another (see FIG. 5). Alternatively, a heat-sealable lidding film may be applied over the flange of the container 20.

Once the top and bottom portions 22,24 are connected, the interior of the container is generally sealed. However, the atmosphere control member 44 selectively allows gas to exchange between the interior and exterior of the container 20. In this manner, the atmosphere inside the container 20 is controlled. This ensures that the foodstuffs remain fresh.

Upon purchase by a consumer, the consumer may open the container 20. The consumer may utilize the bottom portion 24 as a tray. Advantageously, a consumer may reseal the container 20. In particular, the consumer may seal the top and bottom portions 22,24 back together, thus again sealing the interior space of the container and the foodstuffs therein. At that time, the atmosphere control member 44 again regulates the flow of gases between the exterior and interior of the container 20 to prolong the freshness of the foodstuffs during subsequent storage.

The container of the invention may have a variety of other configurations. In one embodiment, the bottom portion of the container may be relatively deep and the top may be shallow, so that the foodstuffs are filled into the bottom portion. In this configuration, the lid could be generally flat (except for preferably including an inset area or areas for the atmosphere control member(s)).

The top and bottom portions may connect one another in other fashions. For example, the top and bottom portions might engage one another in a tongue and groove configuration.

It is possible for the container to include more than one atmosphere control member and those members may be located on the cover or elsewhere (such as on the tray).

The container of the invention has numerous advantages. First, the container is simple in construction. The container can be sealed merely by connecting the top and bottom portions, and without the need for a sealing sheet.

The interior of the container is atmosphere controlled. Once closed, the interior is isolated from the exterior, except via the atmosphere control member(s). This promotes foodstuff freshness.

In addition, once opened, the container can again be closed and sealed. In this manner, the consumer can access the foodstuffs, store unused foodstuffs in the same container, and re-access the unused foodstuffs in the future. When the foodstuffs are re-stored, their freshness is extended because the foodstuffs are again located in an atmosphere controlled interior space.

Because the one or more atmosphere control members are located in an inset area, the containers may be stacked upon one another or other items may be placed on the container without interfering with the operation of the atmosphere control member.

The atmosphere control member is preferably associated with the container itself, so that it is positioned between the interior and exterior and is thus the sole control there between. This ensures that the flow of gases is not prohibited.

A packaging label may be located over the atmosphere control member(s) so that they are not visible, without interfering with their operation.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A container particular suited for transport and storage of fresh foodstuffs comprising:

a tray, said tray having a base with an upwardly extending wall and a flange extending outwardly from a top portion of said wall opposite said base, said tray constructed of an essentially gas impermeable material;

a cover, said cover having a generally closed top with a downwardly extending wall and a flange extending outwardly from a bottom portion of said wall opposite said top, said flange defining a tongue configured to press-fit into engagement with said upwardly extending wall of said tray, said top of said cover divided into a least two compartments, at least a portion of said top at one of said compartments defining a recessed area, an opening located in said cover at said recessed area and said cover defining at least one air passage leading to said recessed area, said cover constructed of an essentially gas impermeable material;

an atmosphere control member comprising a gas permeable membrane, said membrane extending over said opening, said atmosphere control member permitting gas to flow therethrough into and out of said container when said membrane covers said opening; and a packaging label connected to said top of said cover and extending over said recessed area, thereby obscuring said membrane from view, but not blocking said at least one air passage, whereby air may flow between said exterior of said container and said atmosphere control member at said recessed area when said label is connected to said cover.

2. The container in accordance with claim 1 wherein said tray is constructed of a generally opaque material and said cover is constructed of a generally transparent material.

3. The container in accordance with claim 1 wherein said top of said cover is divided into at least three compartments.

4. The container in accordance with claim 1 wherein said tray and cover, when connected by pressing said tongue into an inset portion of said base defined by an upwardly extending wall, substantially seal said container without additional sealing means.

5. The container in accordance with claim 1 wherein said at least one air passage comprises at least one slot formed in said top of said cover.

6. The container in accordance with claim 1 wherein said recessed area comprises a depressed portion of said top of said cover relative to at least one adjacent raised portion of said cover and said at least one air passage comprises a slot formed in said at least one adjacent raised portion of said cover.

7. The container in accordance with claim 1 wherein said recessed area comprises a generally four-sided depressed area within a surrounding generally four-sided raised portion of said cover and said at least one air passage comprises a slot formed in each of said four sides of said raised portion of said cover.

* * * * *